US005732429A

United States Patent [19]

Strickland

[11] Patent Number: 5,732,429

[45] Date of Patent: Mar. 31, 1998

[54] SEALANT SYSTEM FOR WATERPROOFING WELTED FOOTWEAR

[75] Inventor: Barbara A. Strickland, Hudson, N.H.

[73] Assignee: Worthen Industries, Inc., Nashua, N.H.

[21] Appl. No.: 509,170

[22] Filed: Jul. 31, 1995

[51] Int. Cl.[6] ..... A43B 13/39

[52] U.S. Cl. ..... 12/142 D; 36/17 R

[58] Field of Search ..... 36/17 R, 17 PW; 12/142 D

[56] References Cited

U.S. PATENT DOCUMENTS

| | | | |
|---|---|---|---|
| 898,710 | 9/1908 | White | 36/17 R |
| 1,136,799 | 4/1915 | Harris | 36/17 R |
| 1,136,819 | 4/1915 | Lenker | 36/17 R |
| 1,937,826 | 12/1933 | Lineham | 36/17 R |
| 1,993,954 | 3/1935 | Bates | 12/142 D |
| 2,084,874 | 6/1937 | Sutcliffe | 36/17 R |
| 2,480,689 | 8/1949 | Allen | 36/17 R |

OTHER PUBLICATIONS

Manual of Shoe Making, p. 289, copyright 1976.

*Primary Examiner*—Ted Kavanaugh

*Attorney, Agent, or Firm*—Samuels, Gauthier, Stevens & Reppert

[57] ABSTRACT

Method for waterproofing a welted footwear construction. The footwear includes an insole rib joined to an insole. The method includes applying a sealant gel to the outer surface of the insole rib and attaching a welt and an upper to the rib by stitching with a needle. The needle carries the sealing gel into and through the needle holes formed thereby forming a water impermeable seal between the welt, the upper and the rib.

8 Claims, 2 Drawing Sheets

SEALANT SYSTEM FOR WATERPROOFING WELTED FOOTWEAR

FIELD OF THE INVENTION

The invention relates to a sealant system for waterproofing welted footwear.

BACKGROUND AND BRIEF SUMMARY OF THE INVENTION

In welted footwear construction, an insole rib is attached to an insole. The inner surface of the rib defines a rib cavity. A welt is stitched to an upper and to the outer surface of the insole rib, typically by chain stitches. Normally, a lining is interposed between the upper and the rib.

Historically, the problem with welt shoes is that they leak, that is they are not waterproof, unless they are manufactured with a full waterproof bootie or double lasted with a waterproof membrane. The problem with these systems is that not only do they encourage heat build-up inside the shoe but they also increase the weight and cost of the shoes. In welted footwear the 'leaking' is primarily through the holes formed by the needle during chain stitching and water seeping into the footwear from the rib cavity.

The system and sealants of the invention overcome this leaking by sealing the holes formed during chain stitching and by sealing the rib cavity.

An upper footwear assembly usually comprises an upper and a lining which are stitched to the insole rib, in the same stitching step which attaches the welt to the rib.

In the system of the invention, a sealing gel, preferably in the form of a bead, is placed along the outer surface of the rib prior to stitching the welt/upper/lining to the insole rib. When these materials are stitched, the needle carries the gel into the holes and seals the holes formed in the welt/upper/liner/rib. This blocks any water from entering the footwear through the needle holes of the chain stitching.

Although the gel seals the holes formed, the construction is still a sandwiched construction of welt/upper/lining/rib. It is possible for water to seep between the upper and the lining. Accordingly, in another aspect of the invention, prior to stitching the welt/upper/lining to the rib, the sealing gel, preferably in the form of a tape, is placed between the upper and the lining. The tape can be placed so that it overlays the stitch line or is just above the stitch line.

In welted footwear construction the heel assemblies vary and the rib may not extend along the entire perimeter of the inner sole. Different manufacturing steps are employed to fasten the heel to the sole. For example the rib and welt may be trimmed away at the heel and the upper/lining fastened directly to the inner sole. In this embodiment, the sealing gel (tape) is still used between the upper and the lining. Where the upper and lining are nailed to the inner sole on the heel section, the sealing gel, preferably in the form of a flat gasket, is placed under the heel section of the inner sole and then the upper/tape/lining is fastened to the inner sole.

Lastly, in the system of the invention a liquid sealant is coated in the cavity defined by the rib, specifically by applying a sealer inside the rib cavity and on the top of the rib after inseaming (attaching the welt to the insole and trimming).

DESCRIPTION OF THE PREFERRED EMBODIMENT(S)

The waterproofing system of the invention described hereinafter exceeds the standard for footwear water impermeability based on the acceptable failure under water-flex conditions after more than 2,000 flexes. The prior art bootie or double lasted membrane system usually shows failure at 3,500–4,000 flexes. The above system of the invention has consistently passed the flexibility test even at more than 8,000 flexes. The standard test used is a water-immersion flex-tester.

The system of the invention will be described with reference to specific formulations which fall generally into two categories of sealing. A first sealant gel which is used primarily in the assembly of the footwear where a needle pierces the footwear during assembly. The hole formed by the piercing needle, if left unsealed, forms a path for the flow of water from the exterior of the shoe into the interior of the final assembled shoe. Although the preferred embodiment is described in reference to a needle and stitch line, it embraces any assembly operation such as nailing, stapling and the like where penetration of a needle or insertion of a fastener is contemplated.

The other sealant of the invention is a coating sealant which is coated on the inside of the rib cavity after the welt has been attached.

THE SYSTEM

Figure 1:
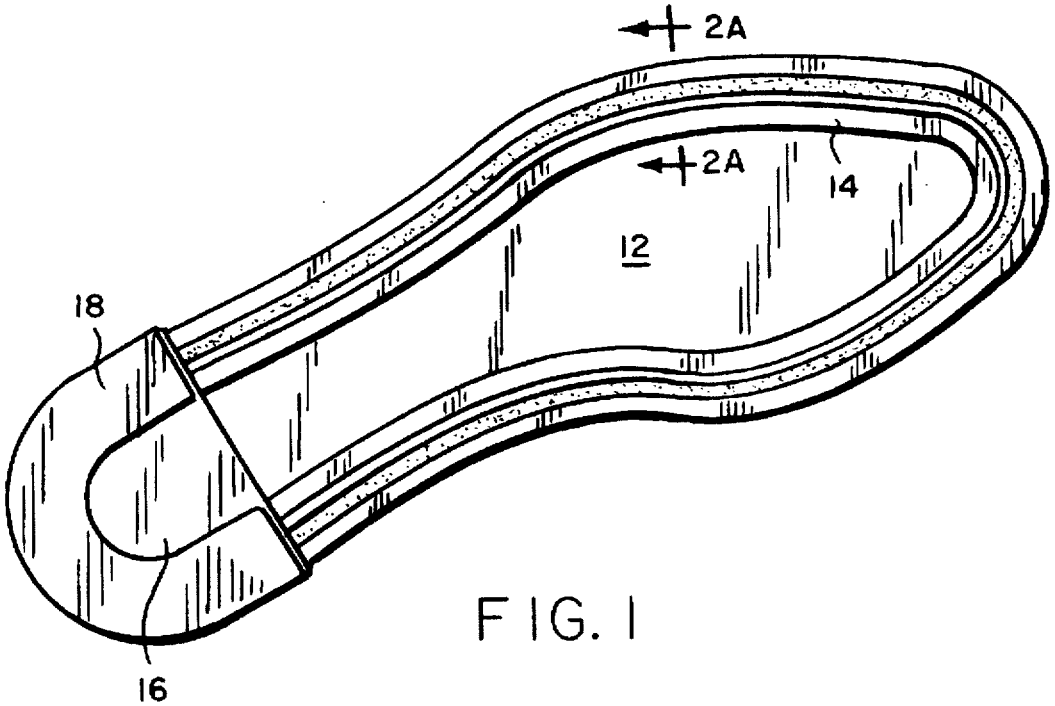
FIG. 1 is an illustration of an insole having a rib secured thereon.

Referring to FIG. 1, a ¾ welt construction inner sole is generally shown at 10 and comprises an inner sole 12 having an insole rib 14 secured thereto. The inner sole is also characterized by a sealing gasket 16 over which is a heel insert 18 such as a 'dutchman'.

Figure 2A:
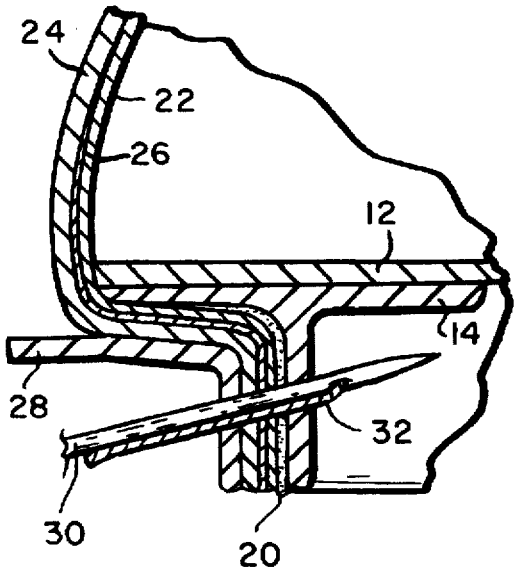
FIGS. 2*a* and 2*b* is a sectional view of FIG. 1 taken along lines 2—2 of FIG. 1 with FIG. 2*a* illustrating the welt/upper/tape/lining/rib construction before stitching and FIG. 2*b* illustrating the same construction after stitching.

Referring to FIG. 2, the welted footwear construction is shown in greater detail and illustrates a sealing gel 20 which originally was placed in a bead-like line along the outer edge of the rib. A lining 22 and an upper 24 are shown and between the lining and the upper is a sealing gel in the form of a tape 26. Lastly, a welt 28 is adjacent the upper 24.

In the attachment of the welt/upper/tape/lining to the rib, a needle 30 penetrates this assembly carrying with it a thread 32. When the needle penetrates this assembly it punctures and carries with it a portion of the gel 20.

Figure 2B:
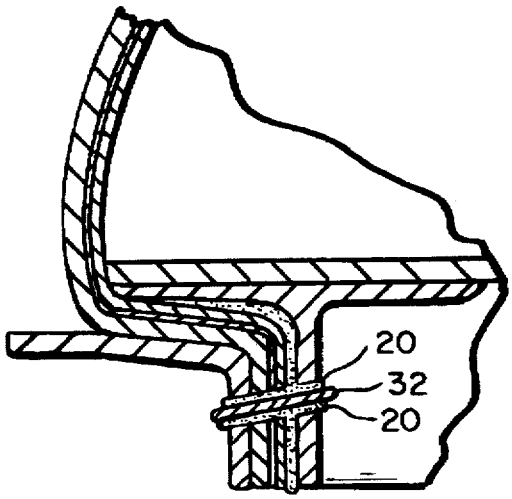

As shown in FIG. 2*b*, when the needle is withdrawn the gel remains in the hole formed by the needle, sealing the same.

Figure 3:
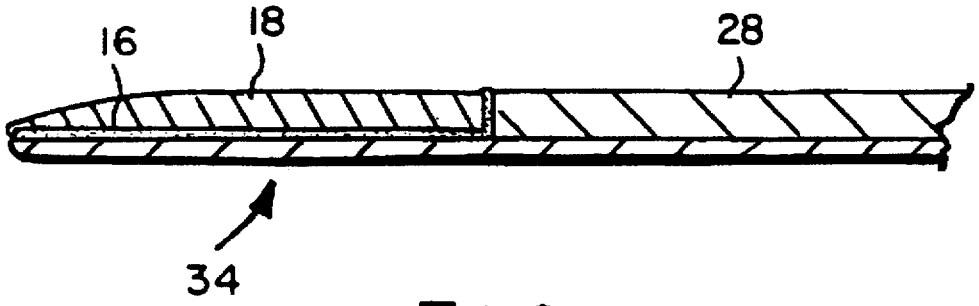
FIG. 3 is a side view of a ¾ welt construction with the welt and rib trimmed.

Referring to FIG. 3, for the ¾ welt construction disclosed herein, the welt and rib are trimmed away from the heel section designated generally as 34. In the heel section 34 is the sealing gasket 16. Also shown is the dutchman 18.

As shown in FIG. 3, the gasket 16 is turned up at its end where it interfaces with the trimmed rib welt 28.

Figure 4:
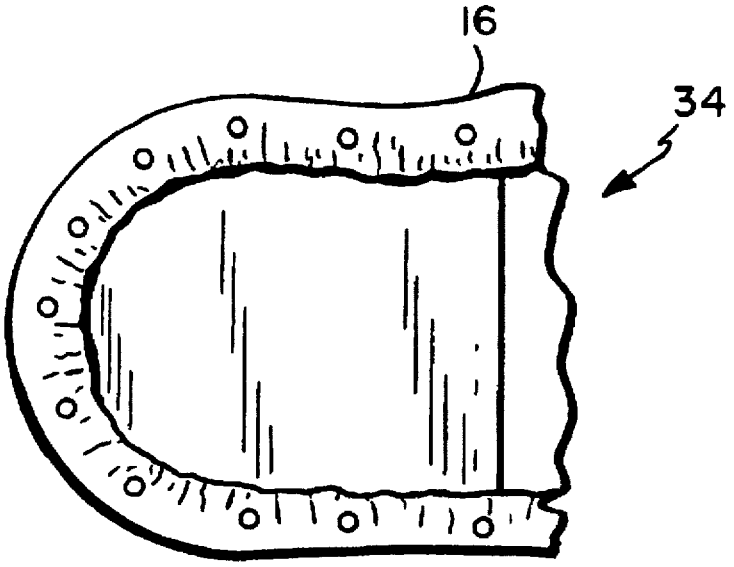
FIG. 4 is a bottom view of a heel section of FIG. 3 illustrating a nail line.

Referring to FIG. 4, the heel section 34 is shown without the dutchman but with the upper/tape/lining nailed to the inner sole through the gasket 16.

Lastly, referring to FIG. 1, the rib cavity, which in this preferred embodiment, again, is defined by the rib and the gasket 16 has coated thereon a liquid sealant to fully waterproof the shoe.

SEALING GELS

EXAMPLE I

Upaco 5750

The following ingredients were mixed at ambient temperature and pressure:

| Weight lbs. | Ingredients | |
|---|---|---|
| 84.45 | Joncryl 74F | |
| 0.50 | Merrol N303 | |
| 15.05 | Alcogum 6940 | |
| Description | Value | |
| RVT | #6/10/25'C | |
| Visc | 42,000–48,000 CPS | |
| Overnight Visc Record | | |
| Flash Solids | 38–42% | |
| pH | 8.0 minimum | |
| Joncryl 74F | S.C. Johnson Polymer | Acrylic emulsion-48.5% |
| Alcogum | Alco Chemical Corp. | Sodium polyacrylate thickener |
| Merrol N303 | Merrand International | Plasticizer |

EXAMPLE II

Upaco 9042

| Weight lbs. | Ingredients | |
|---|---|---|
| 600.0 | Eastoflex E-1003 heat to melting then add slowly | |
| 200.0 | Rextax 2535 | |
| | Allow to melt completely, then add . . . | |
| 200.0 | Rextax 2535 | |
| 1000.0 Spindle 27, speed 50, temp. 350° F., Range 1000–1500 cps. | | |
| Eastman E1003 | Eastman Chemical | Amorphouspolyolefin-APO |
| Rextax 2535 | Rexene Corp. | Amorphous polyalpha-olefin-APAO |

Other possible sealing compositions include acrylics, polyalphaolefins, SBS and SIS copolymers, urethanes, chlorinated rubber compounds and extended versions thereof.

The above compositions can either be extruded in bead-like form or as a tape. When they are to be applied to the insole rib, the compositions are preferably extruded in bead-like form. Additionally, the composition is formulated to be dimensionally stable or free standing.

The above compositions can also be extruded onto release paper and used as a gasketing material for the heel section as will be described. They have also been cast on various backers, made into a tape and used between the lining and the upper. The tape may also be used between other pieces to be stitched together, as a way to self-seal the stitch holes. To form sealing tape, the compositions can also be extruded at thicknesses of 5 mils to 50 mils onto release paper, or non-wovens, polyolefin films, or fabrics in thicknesses from <1 mil to 100 mils.

The above compositions for sealing beads, gaskets or tapes have rheological and sealing properties which are especially adapted for use in combination with the stitching steps and/or nailing steps in the assembly of the welted footwear. More specifically, after the gel is extruded its outer surface 'sets'. For a liquid bead (Example I) extruded at a diameter of 5 cm, the outer surface would 'set' between 30 to 60 minutes. Typically, the bead is extruded directly on the rib. The center remains soft and does not set for between 3 to 5 hours. When extruded hot (Example II) as a bead, say in a dimension of 3 cm the outer surface sets between 30 to 60 seconds after which it is dimensionally stable and may be handled. The center of the bead remains soft and flexible for a minimum of 30 days.

SEALING LIQUIDS

EXAMPLE III

Upaco 5711

The following ingredients were mixed at ambient temperature and pressure until homogenous.

| Weight lbs. | Ingredients |
|---|---|
| 77.96 | Joncryl 74F |
| 21.94 | Dispercoll 8464 |
| Check pH of Dispercoll before adding - must be 6.0 min | |
| 0.10 | Alcogum 6940 |
| Description | Target |
| RVT | 1/20/25'C |
| Visc | 200–300 CPS |
| Overnight Visc Record | |
| Flash Solids | 34–37% |
| Solids | 34–37% |
| pH | Record |
| Color | White |

EXAMPLE IV

Upaco 5722

The following ingredients were mixed at ambient temperature and pressure until homogenous.

| Weight lbs. | Ingredients | |
|---|---|---|
| 77.14 | Joncryl 74F | |
| 21.04 | Dispercoll 8464 | |
| Check pH of Dispercoll before adding - must be 6.0 min | | |
| 0.82 | Alcogum 6940 | |
| Mix at least 20 min. | | |
| Description | Target | |
| RVT | 2/20/25'C | |
| Visc | 500–600 CPS | |
| Solids | 40–45% | |
| pH | Record | |
| Color | White | |
| Joncryl 74F | S.C. Johnson Polymer | Acrylic emulsion-48.5% |
| Dispercoll 8464 | Bayer, Inc. | Polyurethane dispersion-40% |
| Alcogum | Alco Chemical Corp. | Sodium polyacrylate thickener |

EXAMPLE V

Upaco No. 5750, a high viscosity acrylic "gel", was extruded around the outside of the rib manually using a squeeze bottle with a ¼" opening. After the gel was extruded, it had to set between one hour and three hours of extrusion; the gel was (crusty) on the outside but still liquid inside. The No. 5750 gel was brushed onto the lining prior to side lasting to form a barrier to prevent water leaking between the lining and the upper. The welts were stitched.

Upaco No. 9023A was used as a heel seat gasket. This material is extruded into the heel area to seal around the heel nail holes and fill the gap between the end of the welt and the "Dutchman" in ¾ welt shoes. This material was also extruded onto a release lining and die cut to cover the full heel area before nailing; when nailed through, it flowed into the nail holes and plugged them, much like the gel flows into and plugs the welt stitch holes. The sealed welted footwear was tested according to immersion water-flex test standards and did not fail until 16,000 flexes.

A thin sealer, No. 5711, was coated on the inside of the rib cavity, paying special attention to the inside stitch holes. The coating thickness was 1 mil. After one hour a second coat of sealer, using No. 5722, was applied to the entire inside rib area, the inseam (top of the trimmed rib) and the insole tack holes. The coating thickness was 2 mils.

DISCUSSION

These sealing liquids give a fully waterproof welt shoe without a membrane or bootie. The 5700-type liquid systems are made of compounded acrylic emulsions. The compounding is to enhance rheological properties and water-resistance, especially at the lower viscosities. Sealers (5711/5722) are coated inside the entire rib cavity as a safety measure to further block water from entering.

In general No. 9042 is extruded directly onto the rib, stays soft and flexible, and has virtually no time limitations for application. This material is a blend of two amorphous polyolefins and must be extruded hot (325°–340° F.).

The extruded gel bead on the rib (5750 or 9042) is compressed between the lining and the rib. The welt is sewn on (needle pieces welt, upper, gasket/tape, lining, gel and rib). The gel forms a dam around needle holes and also pulls through into the hole to block water coming from outside. The gasket/tape is between the upper and lining at and slightly above the stitching to stop seeping water between the lining and the upper.

After being extruded the gel initially sets with a stable outer shell with a viscous inner core. This provides dimensional stability to the gel such that it remains in place during subsequent handling and stitching operations. As is well known, the needle which carries the thread has a greater dimension than the thread. When the needle punches through the materials to be sewn, a larger hole is necessarily formed than the dimension of the thread. The needle when punching through the gel carries with it the viscous core of the gel which fills and seals the hole. Further, the exposed surface of the gel which the needle initially punches through and then withdraws self-seals on its surface.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A method for waterproofing a welted footwear construction where an insole rib is joined to an insole and defines therewith a rib cavity which method comprises:

applying a sealing gel to the outer surface of the insole rib; and attaching a welt and an upper to the rib by stitching with a needle, the needle carrying the sealing gel into and through the hole formed and damming throughout the needle hole thereby forming a water impermeable seal between the welt, the upper and the rib.

2. The method of claim 1 which comprises:

applying a sealant to the inner cavity, the sealant covering the surface of the inner sole and the rib.

3. The method of claims 1 or 2 wherein the footwear construction includes a liner between the upper and the sealing gel and which method comprises:

placing sealing gel between the upper and the lining prior to stitching.

4. The method of claim 3 wherein the welt construction is a ¾ welt construction and the insole includes a heel section which method comprises:

placing the sealing gel on the heel section; and fastening the upper to the heel section with fasteners the sealing gel flowing into and sealing the holes formed by the fasteners.

5. The method of claim 3 which comprises:

applying the gel in the form of a tape between then upper and the liner.

6. A method for waterproofing a welted footwear construction where an insole rib having an outer surface is joined to an insole and defines therewith a rib cavity which method comprises:

applying a bead of sealing gel to the outer surface of the insole rib;

placing a tape of sealing gel between the upper and the liner prior to stitching;

attaching a welt, an upper end and a lining to the rib by stitching with a needle, the needle carrying the sealing gel into an through the hole formed and damming throughout the needle hole thereby forming a water impermeable seal between the welt, the upper, the liner and the rib.

7. The method of claim 6 wherein the welt construction is a ¾ welt construction and the insole includes a heel section which method comprises:

placing sealing gel on the heel section; and fastening the upper and the liner to the heel section with fasteners the sealing gel flowing into and sealing the holes formed by the fasteners.

8. The method of claims 6 or 7 which comprises:

applying a sealant to the inner cavity, the sealant covering the surface of the inner sole and the rib.

* * * * *